US006199635B1

(12) United States Patent
Brunet et al.

(10) Patent No.: US 6,199,635 B1
(45) Date of Patent: Mar. 13, 2001

(54) SHIFTING APPARATUS AND METHOD FOR USE IN TUBULAR STRINGS FOR SELECTIVE ORIENTATION OF TUBULAR STRINGS BELOW THE SHIFTING APPARATUS

(76) Inventors: Charles G. Brunet, 2115 Argonne, Apt #6, Houston, TX (US) 77019; Michel J. Bouchard, 3131 West Alabama, suite 211, Houston, TX (US) 77098

( * ) Notice: Subject to any disclaimer, the term of this patent is extended or adjusted under 35 U.S.C. 154(b) by 0 days.

(21) Appl. No.: 09/238,534

(22) Filed: Jan. 27, 1999

(51) Int. Cl.[7] ..... E21B 47/024

(52) U.S. Cl. ..... 166/255.2; 166/117.7; 166/332.4; 166/386

(58) Field of Search ..... 166/381, 386, 166/341, 50, 117.7, 332.1, 332.4, 255.2, 255.1

(56) References Cited

U.S. PATENT DOCUMENTS 3,797,573 * 3/1974 Crowe .
5,549,161 * 8/1996 Gomez et al. ..... 166/255.1

* cited by examiner

*Primary Examiner*—Roger Schoeppel

(74) *Attorney, Agent, or Firm*—Parks and Associates

(57) ABSTRACT

This invention relates to a shifting apparatus and method for use with a tubular string set in a well for unlocking, selective orientation and relocking of sections of the tubular string below the shifting apparatus of this invention, while the tubular string sections above the shifting apparatus of this invention remain substantially unchanged in their orientation in the well including a lower tubular wall member connected to the tubular string above the shifting apparatus, an upper tubular wall member connected to the lower tubular wall member for controlled movement and orientation between the lower tubular wall member and the upper tubular wall member and connected to the tubular string below the shifting apparatus, and an internal tool located inside the upper and lower tubular wall members for releasablely and selectively locking into the upper and lower tubular wall members for holding the upper and lower tubular walls engaged until orientation of the tubular string below the shifting apparatus is desired, and for releasablely and selectively unlocking the upper tubular wall member from the lower tubular wall member for allowing the upper tubular wall member and the tubular string below the shifting apparatus to be rotated by the internal tool member, with the lower tubular wall member and the tubular string above the shifting apparatus remaining substantially unchanged in orientation in the well, by lifting the internal tool up hole and rotating it to orient the upper tubular wall member connected to the tubular string below the shifting tool to the desired orientation.

22 Claims, 7 Drawing Sheets

SHIFTING APPARATUS AND METHOD FOR USE IN TUBULAR STRINGS FOR SELECTIVE ORIENTATION OF TUBULAR STRINGS BELOW THE SHIFTING APPARATUS

BACKGROUND OF THE INVENTION

This invention relates generally to apparatus and methods for using a shifting tools in drilling wells, and drilling multi-lateral wells. It has special application in near vertical wells, deviated wells, or horizontal wells, and in their completion, re-completion, setting whip stocks, setting premilled window sections, and/or setting other tools down hole where the process of correct orientation of such tools is important. This invention and method applies whether the problem relates to the whole casing string, tubing string, coil tubing string, etc. is required to have some section of it oriented while the rest of the section remains substantially unchanged.

Thus this invention relates to orientation solutions in a well where there is need to orient tools and equipment down hole in a well when either because the tubular walls can not be rotated because of binding tubular material in the well in which it is located or drag and high torque caused by the earth's friction on the tubulars, or just because it makes better economic sense to rotate by using a shifting tool to orient the particular section desired to be orientated while the tubular materials up hole of said shifting tool remain unchanged in their orientation in the well.

In the case of lateral or multi-lateral well drilling, which is on the increase, there are numerous occasions because of the bends in the casing or tubing string or drag and high torque caused by the earth on the tubulars that the up hole portions of said tubular members bind in the hole and they can not be rotated to orient the tools or materials at the desired location by rotating the whole tubular member. In this environment a shifting tool such as this invention has great application.

Since the increase in usage of lateral or multi-lateral well drilling, there has also been an increase in the problems associated with their drilling because they are being used in more and different well conditions and at more extreme angles of deviation from the vertical well bore than ever before. Thus many techniques have been developed to solve some of these problems but only with the result of creating other and different problems, not the least of which is providing a simple and universal assembly and method which can be used for both drilling and completion and also entry and reentry at a later date.

Also many of these solutions are proprietary and they are designed to only be used with other proprietary completion equipment, which is very expensive and specially adapted for use with only one companies equipment. This condition thus leaves many others without a solution to their problems of having a shifting tool for their simple use at a desired location down hole in a well without rotating the whole tubular string or using a complete proprietary system just for the single need to orient particular tools.

Because of the improved drilling technology today, the wells into which premilled window sections may be set can have high angles even in excess of 50 degrees from vertical. Clearly in such environments the earth about the tubular string of pipe would act as a "brake shoe" over a significant portion of the tubular string to the point that the whole string may be impossible to turn for the purpose of rotating the window section into a desired location for the commencement of drilling a lateral well through the window section.

Also in the prior art, because of wells having depths of 10,000 feet or greater today, there is an even greater need for finding the exact orientation of a down hole tool and for having the ability to manipulating them in place. For example in a well having a depth of 10,000 feet, just the spring in the drill string and running tools can have several feet of movement or "slack" between the surface and the down hole section being desired to be manipulated. Also because of this "cork screw" effect and the depth the tubular material is subject to much greater resistance and likelihood of binding in the well bore exist, with the inability to use such tools as junction sections for drilling multi-lateral wells or their loss down hole because the junction section could not be orientated in the desired direction to drill a multi-lateral well.

Also in the prior art there were many complicated shifting tools with many complicated parts in them and they generally remained down hole after their work of shifting and orientation was complete. This created problems in the bore of the tubular materials in which they were used as this reduced the size of the inside diameter of the tubular materials and restricted their creative use for other purposes.

In yet some other prior art shifting tools, there was no way to obtain a positive indication on the surface of when the apparatus was correctly oriented with respect to the lateral or multi-lateral about to be manipulated and then provide a way to lock the shifted tool in place against inadvertent movement.

While other shifting tools in the prior art have been somewhat successful in shifting the tools to be oriented, they have required additional trips into the hole to retrieve them and have driven up the cost of using the shifting tools in the modern market place of today.

Clearly until the use of premilled windows in wells today, there was not as much need to turn the casing down-hole in order to position it in a certain orientation and thus the creation of some of the demand for shifting tools today. The modern problems of multi-lateral drilling through premilled windows have only magnified the need for simple and effective shifting tools because of the torque problems which can prevent the orientation of a premilled window which can result in the premilled window being lost from use and the failure to drill the multi-lateral well or if drilled, only at great additional costs.

For example U.S. Pat. No. 5,615,740 is typical of the prior art in that while it provides for a removable sleeve that is used in the cementing operations, involving a premilled window, the sleeve is used to find the orientation of the premilled window, to allow the cement to pass thru the premilled window during the cementing operations and to provide pressure integrity during the installation of the casing, but does not provide any capability with the system to rotate the casing prior to the cementing operations without rotating the entire casing string. While this would work with casing strings which were capable of being rotated, it would be a complete loss or a great expense if the casing string were not capable of being rotated.

Also in the prior art some tools such as U.S. Pat. No. 5,775,444 were constructed of high strength steel and complicated parts to manipulate such things as drilling motors in a down hole environment and if significant problems developed the tool had to be milled out down hole. Alternatively many of these mechanisms on the inside of the more complicated tools are an integral part of the tool and cannot be removed once the tool is down hole without removing the entire housing. Thus the costs of removal of such tools was significantly increased.

OBJECT OF THE INVENTION

It is the object of this invention is to provide an apparatus and methods for shifting and orientating tools used in casing, tubular strings, and coiled tubing when the tools are down hole, without changing the orientation of the casing, tubular strings, or coiled tubing above the shifting apparatus, while the tools used are oriented.

Also it is an object of this invention to be able to orient tools in conditions where there are numerous bends in the casing or tubing string even when there is drag and high torque caused by the earth being pressed against the tubular materials on the portion above the shifting apparatus such that the tubing, casing, or coiled tubing can not be rotated because of the earth and the tubular materials.

It is a further object of this invention to provide a simple and universal assembly and method which can be used for both drilling and completion and also entry and reentry into wells and still not leave any obstruction in the well bore after the shifting apparatus has completed it orientating function.

A further object of this invention is to provide a simple shifting apparatus which is simple and inexpensive and can be used with any casing, tube string, or coiled tubing in the industry and do not require that this apparatus be used with other proprietary equipment in order to be successfully used in a well operation.

Yet another object of this invention is to provide a shifting apparatus and method which is not sensitive to the "slack" which occurs especially in wells having depths of 10,000 feet or greater, so that the shifting apparatus continues to operate to orientate the desired tools in the desired direction and thus not be affected by the "slack" or "cork screwing" of the tubular material on the way to where the shifting apparatus is located to perform the method of orientating the desired tool, thereby preventing the loss of such tools as junction section for drilling multi-lateral wells.

It is also an object of this invention to provide a shifting apparatus, which after it has been determined that the method of this invention will not be needed in the well, that the internal tools of this shifting apparatus can be removed from the well by a wire line, which leaves the bore of the well completely unobstructed after the internal tool is removed and thus eliminates the need for a tubular string run into the well to remove the shifting apparatus from the well bore or leaving the well bore plugged by the internal tool.

Also as part of the object of this invention, the shifting apparatus of this invention provides a positive locking of the shifted and oriented tool against inadvertent movement and provides a positive locking and indication at the surface of the well when the apparatus is correctly oriented with respect to the lateral or multi-lateral in the well.

Another object is to provide a shifting apparatus and method which eliminates additional trips into the well bore to retrieve the internal tool and thereby reduce the cost of using the shifting apparatus and methods of this invention.

It is also an object of this invention to provide a shifting apparatus and method which can be used with premilled window in wells today which are being drilled at greater and larger deviations from vertical and longer distances out from the vertical well, but yet still be used to orient the premilled window to a desired orientation whether the casing, tubular string, or coiled tubing above the shifting apparatus of this invention can be rotated.

Also it is an object of this invention to provide a shifting apparatus which can be used in the completion of a well in a multilateral well such that the premilled window is orientated to the desired direction and the internal tool in the apparatus of this invention is removed, but the remaining portion of the shifting apparatus of this invention function in the cementing operation to provide pressure integrity during the installation of the casing.

Another important object of this invention is to provide a shifting apparatus which is simple and inexpensive to manufacture and is not made from high strength materials but of simple parts which because of the nature of the invention operate very effectively and inexpensively.

It is an object of this invention to have the moving parts including the engaging and separating parts located inside the shifting apparatus of this invention to prevent them from being clogged and made non-operational by debris being deposited in those parts by the normal dirty operating conditions of a well bore.

Yet further and additional benefits and improvements of the invention will be appreciated by others skilled in the art and those advantages and benefits of the invention will become apparent to those skilled in the art upon a reading and understanding of the following detailed description.

BRIEF DESCRIPTION OF THE DRAWINGS

This invention may be practiced in certain physical forms and arrangements of the parts herein described, but a preferred embodiment of which will be described in detail in the specification and illustrated in the accompanying drawings which form a part hereof.

Referring now to FIG. 1 the shifting apparatus of this invention, it is generally shown at reference number 10. Also in this FIG. 1 is shown a tubular string, which in this case is a casing string 11 in the process of being connected to the shifting apparatus 10 of this invention on generally the up hole end 12 of the shifting apparatus 10. The shifting apparatus 10 is also shown in FIG. 2, with the other end or down hole end, generally referred to as 13, being in the process of being connected to a premilled window section 14 to be used in drilling a multilateral well. Once assembled in the configuration shown in FIG. 1, this assembly would be put down the well bore to the desired location for the premilled window section 14. Once in place, however, and before drilling a multilateral well or permanently setting the window section 14, an orientation check would be made of the premilled window section 14 to see if it is in the desired orientation to drill a multilateral well. If the premilled window section 14 was determined to not be in the desired orientation, and the casing string 11 can not be rotated because of its binding in the well bore, then the shifting apparatus 10 would be activated to adjust only the premilled window section 14 without having to move the casing string 11 above the shifting apparatus 10.

Figure 1:
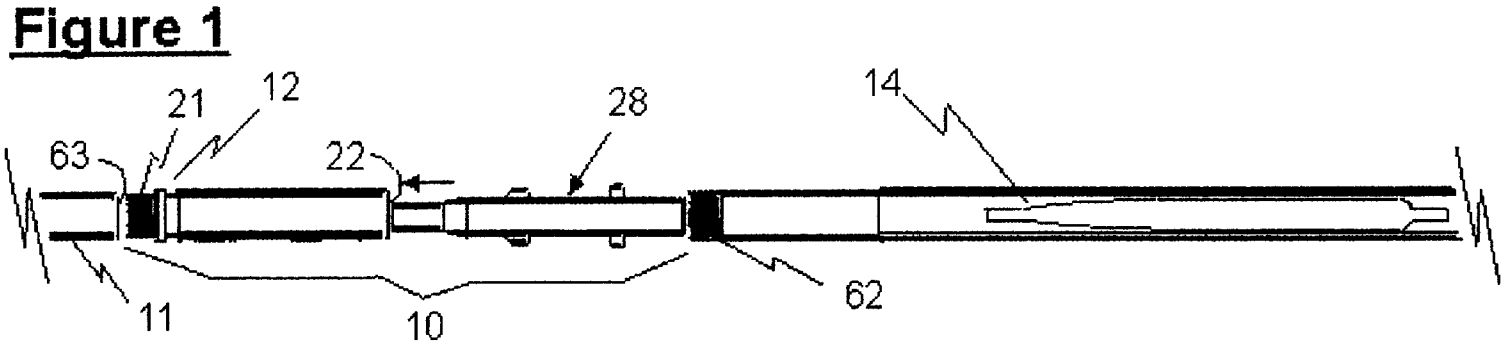
FIG. 1 Is a didactic assembling view of the shifting apparatus of this invention being put together in a casing string with a premilled window junction section in preparation of being placed in a well bore.

It will be understood by those skilled in the art that in many cases the casing string 11 would not be able to be rotated to the desired orientation in the well bore of wells when they are highly deviated from vertical, because the earth's "Drag" against the casing string 11 all along the casing string 11 would prevent the casing string 11 from being turned in the well bore. In such a case, the shifting apparatus 10 of this invention would be activated. Thus in prior art wells, without the shifting apparatus 10 of this invention, a premilled window section 14 could be lost from use after having put it down the well bore.

To fully understand how one embodiment of the shifting apparatus 10 of this invention is activated and operated, requires a full understanding of how the shifting apparatus 10 of this invention is assembled. So referring to FIGS. 4 & 5, it can be seen that the lower tubular wall member 15 and upper tubular wall member 16 are sized to have the lower tubular wall member 15 be inserted into and through the upper tubular wall member 16 for connection to the casing string 11. Also from FIGS. 4 & 5 it will be appreciated that lower tubular wall member 15 has an inside diameter 35.

It will be noted in this embodiment that a portion of the upper tubular wall member 16 has within it, a standard inside diameter 17, and a receiving member 18, which is formed inside the upper tubular wall member 16 by increasing the inside diameter of the upper tubular wall member 16 from the standard inside diameter 17. The upper tubular wall member 16 on it's down hole end 13, has standard female casing threads 22, which form the down hole end of the shifting tool 10, which is then attached to the premilled window section 14 by screwing it on to the male threads 62 on the premilled window section 14.

The lower tubular wall member 15 has a portion of the outside diameter 19 of the lower tubular wall member 15 sized to be received into the receiving member 18 of the upper tubular wall member 16. The other part of the lower tubular wall member 15 is sized to form an insertion member 20 whose outside diameter is sized to be slidablely passed through the standard inside diameter 17 of the upper tubular wall member 16. The insertion member 20 of the lower tubular wall member 15 is then attached to the female threads 63 in the casing string 11 by screwing standard male casing threads 21 therein. The standard male casing threads 21 thus define and form the up hole end 12 of the shifting apparatus 10.

As this lower tubular wall member 15 only slides through the standard inside diameter 17 of the upper tubular wall member 16, a "No Go" or retainer ring 23 is put in place on the insertion member 20 after it passes out of the upper tubular wall member 16. This retainer ring 23, thus limits the upward travel of the upper tubular wall members 16 when the shifting apparatus 10 of this invention is activated by the upper tubular wall member 16 being advanced up hole, as will be later explained. Also it provides the well operator with a positive indication of when the upper tubular wall member 16 has been properly advanced up hole in the method of operation of this shifting apparatus 10, and it eliminates mistakes in the shifting operation by the well operator. The lower tubular wall member 15 is prevented from being pushed through the upper tubular wall member 16 by the lip 24 which is created when the receiving member 18 of the upper tubular wall member 16 is formed by having it's increased inside diameter increased from the standard inside diameter 17 of the upper tubular wall member 16. Also the lower tubular wall member 15 has a lip 25 formed at the point where the outside diameter 19 is reduced to form the insertion member 20 which is slidablely passed through the standard inside diameter 17 of the upper tubular wall member 16. Thus the two lips 24 and 25 would butt together to prevent any inadvertent disconnecting of the upper and lower tubular wall members 15 & 16 in the other direction. It should be appreciated that between the two lips 24 and 25 butting together and the retainer ring 23 acting as a "No Go" the upper and lower tubular wall members 15 & 16 are cabable of free motion up and down hole or to rotate within each other, if unchecked or not controlled. While this free motion both up and down and rotationally within the upper tubular wall member 16 and lower tubular wall member 15 is useful for the practice of this invention, it must be controlled and actuated on demand.

In some embodiments, control of the rotational motion within the upper tubular wall member 16 and lower tubular wall member 15 is achieved with the use of members which engage to prevent rotational motion while engaged, but allow rotational motion when it is desired to rotate the upper tubular wall member 16 which is attached to the premilled window section 14 below the shifting apparatus 10, shown in the embodiment of FIG. 1. For example in the embodiments shown in FIGS. 4 & 5, it can be seen that engaging teeth 27 are formed from the outside diameter 19 of the lower tubular wall member 15 at the point where the lower tubular wall member 15 has it's outside diameter reduced to be slideablely passed through the inside diameter of the upper tubular wall member 16. In effect the lip 25 is fabricated into engaging teeth 27. In the upper tubular wall member 16 engaging teeth 26 are formed from the material of the inside diameter of the upper tubular wall member 16 at the point where the inside diameter of the upper tubular wall member is increased to the diameter of the upper tubular wall sufficient to form the receiving member 18 of the upper tubular wall member 16. In effect the lip 24 is fabricated into engaging teeth 26. Thus when the engaging teeth 26 and 27 are engaged the upper and lower tubular wall members 15, & 16 are prevented from rotational motion, but when they are not engaged the upper and lower tubular wall members 15 & 16 may be freely rotated about each other. Therefore it should be remembered that the upper tubular wall member 16 is connected to the premilled window section 14, at least in this embodiment, and may be rotated to a desired orientation when the engaging teeth 26 of the upper tubular member 16 are free from the engaging teeth 27 of the lower tubular member 15.

It will be understood by those skilled in the art that the number of engaging teeth 26 and 27 will depend on the radial degree of accuracy desired in the orientation process by the application where the shifting tool 10 is being used. For example the more engaging teeth 26 & 27 the higher the accuracy by degree of rotation and the fewer engaging teeth 26 & 27 the less accurate the degree of rotation achieved. For example if there were only 4 engaging teeth 26 & 27 the accuracy of rotation would be 90 degrees because when the teeth are reengaged after separation they will align on 90 degree increments. However if there are 120 engaging teeth 26 & 27 then the accuracy of rotation would be 3 degrees when the re-engagement of the teeth occur. Also those skilled in the art will appreciate these teeth must have angled slope from the apex 34 to the valley 36 of the engaging teeth so as to not lock up on the apex 34 but slide from the apex 34 to the valley 36 for their controlled realignment.

Control of the free motion up and down hole which allows controlled actuation, in one embodiment of this invention, is provided by the insertion member, shown generally at 28, acting in combination with the upper and lower tubular wall members 15 & 16. This insertion member 28 can also be used with the embodiments using the engaging teeth 26 & 27 to provide the motive force to rotate the upper tubular wall member 16 and for the disengagement of the engaging teeth 26 & 27 to allow the rotation to occur. This insertion member 28 is as shown in numerous figures to be inserted into the upper and lower tubular wall members 15 & 16 and it is designed to operate in conjunction with the upper and lower tubular wall members 15 & 16 to achieve the objects of this invention.

Figure 4:
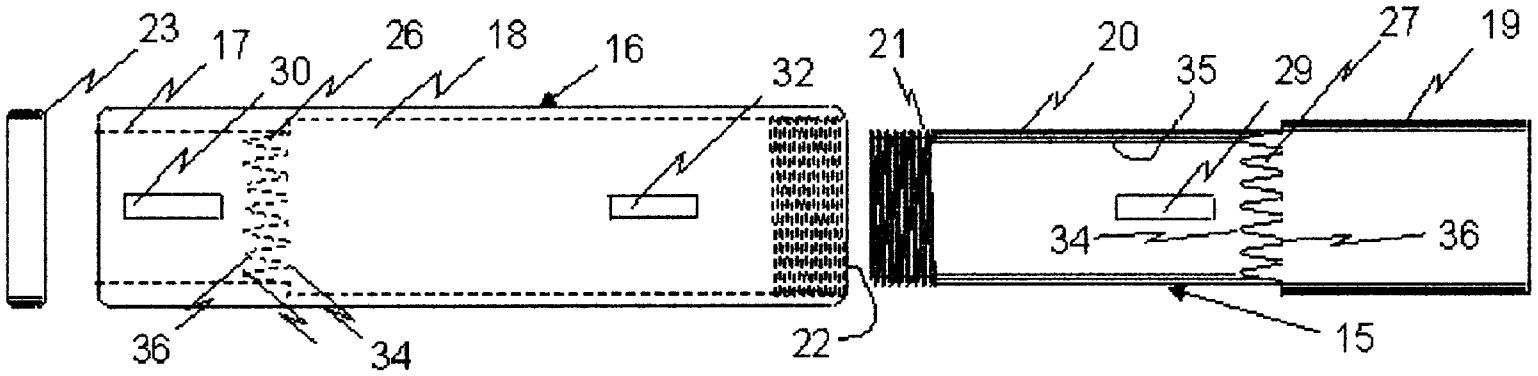
FIG. 4 Is an assembling view of the upper and lower tubular wall members in cross section and with phantom lines which shows how the lower tubular wall member is received into the receiving member formed inside the upper tubular wall member.
Figure 5:
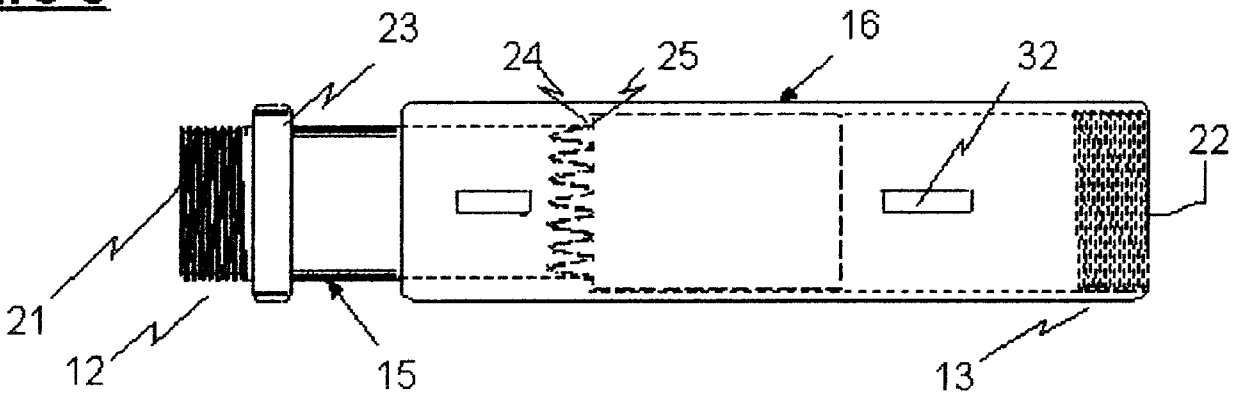
FIG. 5 Is the assembled view of FIG. 4 with the no go member connected to the lower tubular wall member and the outside diameter of the lower tubular wall member being fully received inside the upper tubular wall member.
Figure 6:
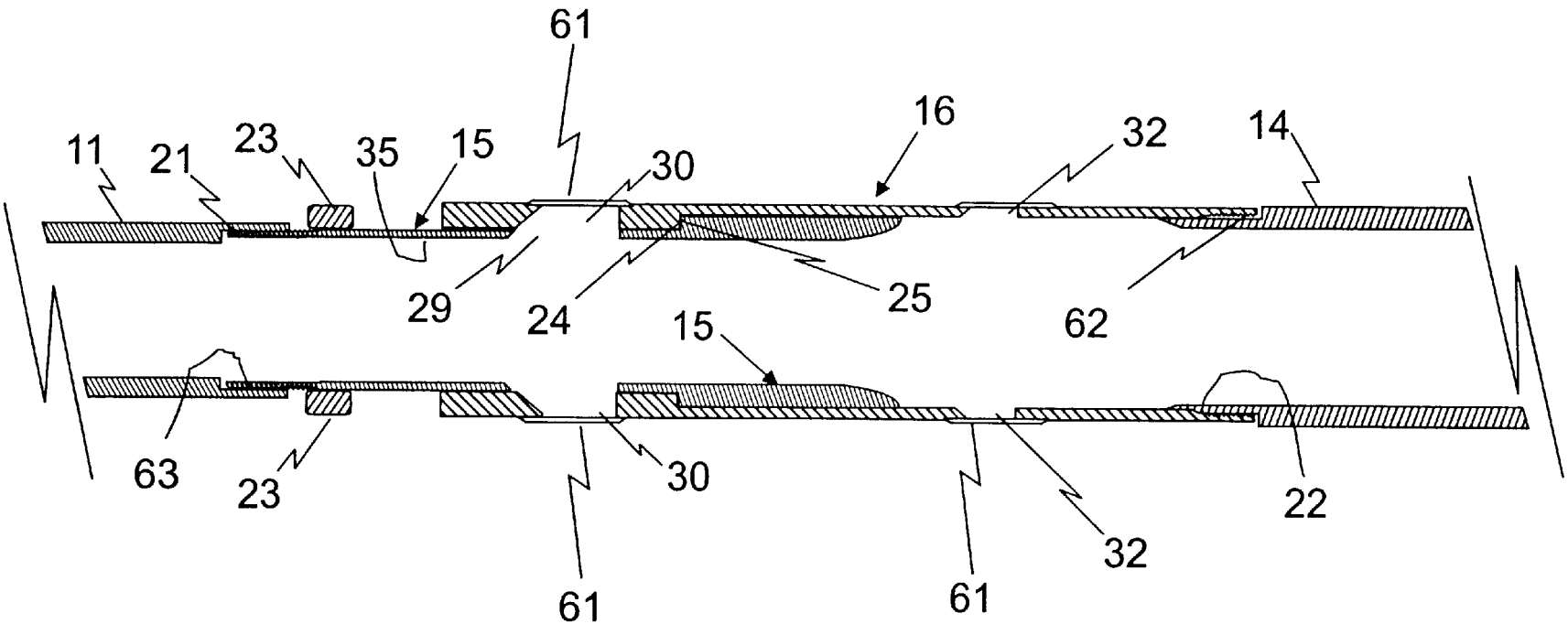
FIG. 6 Is a cross sectional view of FIG. 5 which has been rotated 90 degrees and shows the upper tubular wall member connected to the window section and the lower tubular wall member connected to the casing, but with the internal tool member removed from the upper and lower tubular wall members.

The parts of the upper and lower tubular members 15 & 16 which operate with the insertion member 28 can be easily seen in FIGS. 4, 5, & 6. In these figures it will be seen that the upper tubular wall member 16 is provided with at least one aperture 30 and the lower tubular wall member 15 is provided with at least one aperture 29. These two apertures 29 & 30 are positioned on their respective upper and lower tubular wall members 15 & 16 such that, when the lips 23 and 24 are against each other and the lower tubular wall member 15 is fully inside the upper tubular wall member 16, they can be fully aligned with each other. The importance of this alignment will be more fully understood from further discussion below of how they work with the insertion member 28.

Also on the upper tubular wall member 16 toward the downhole end 13 is located another aperture 32 and the importance of this aperture 32 will also be more fully understood from the further discussion below on how it works in conjunction with the insertion member 28.

It would be understood by those skilled in the art that those apertures 30 and 32 would in many embodiments have cover plates 61, as shown in FIG. 6, over all the apertures in the upper and lower tubular wall members 15 & 16 for the purpose of keeping debris from entering the bore of the casing string 11. This would be especially true where cementing the casing is to occur after the orientation of the premilled window section 14 to a permanent position to drill the multilateral well.

Figure 2:
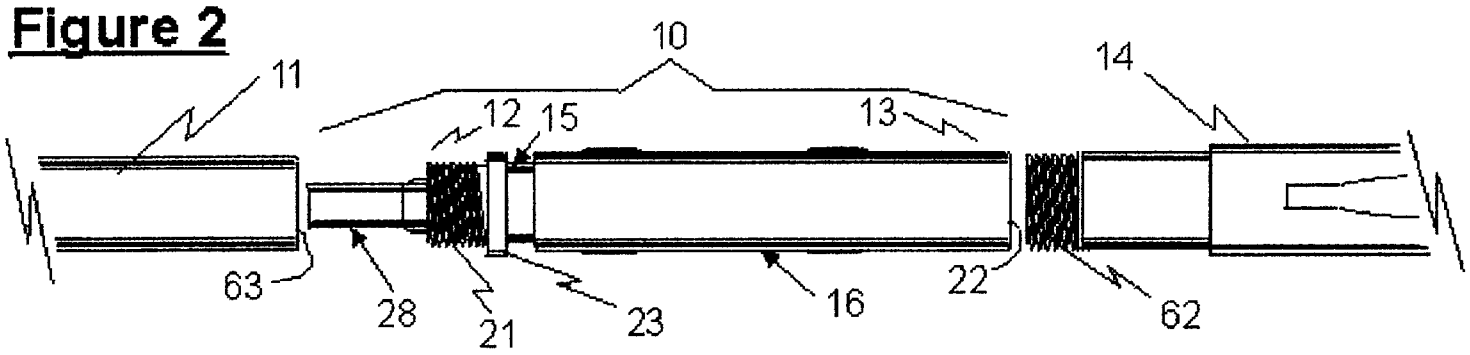
FIG. 2 Is an assembling view of the shifting apparatus of this invention with the internal tool in place inside the upper and lower tubular wall members and in the process of being connected to the casing and to the window section.
Figure 3:
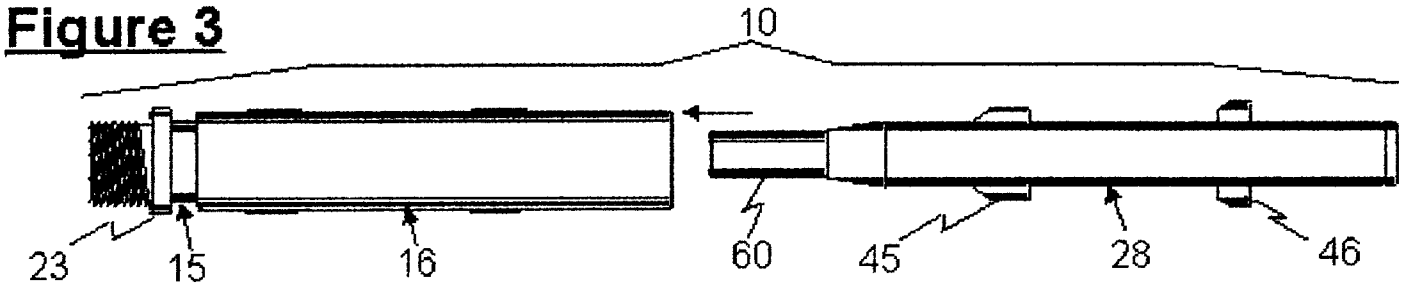
FIG. 3 Is an assembling view of the upper and lower tubular wall members completely inserted into each other and with the internal tool being inserted into the joined upper and lower tubular wall members.
Figure 7:
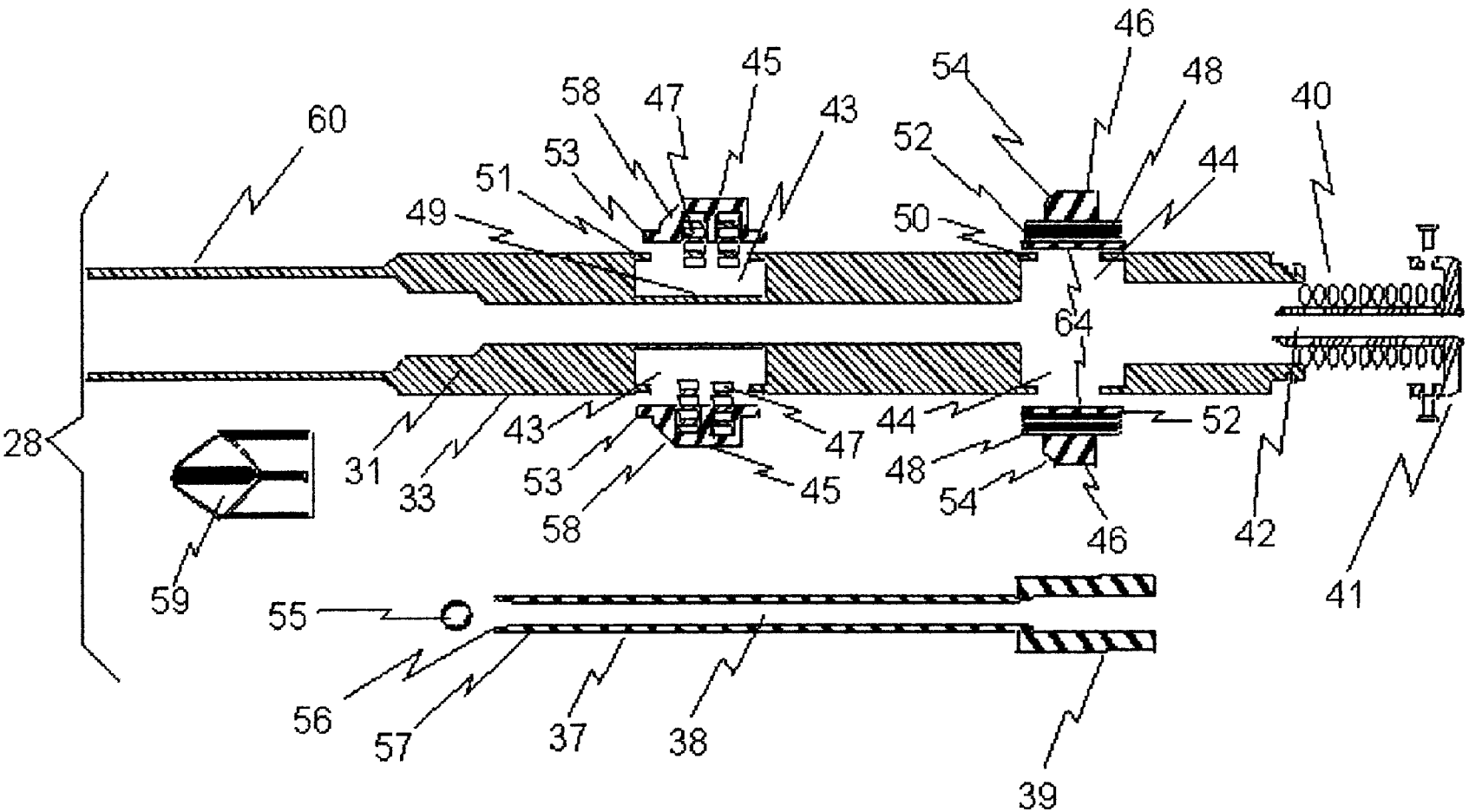
FIG. 7 Is an exploded cross section view of the internal tool member with out the upper and lower tubular wall members being shown.

It can be seen in FIGS. 1,2,& 3 that an insertion member 28 is inserted into the upper and lower tubular wall members 15 & 16 and is designed to selectively and releasablely lock and unlock into the upper and lower tubular wall members 15 & 16. How the insertion member 28 works with the upper and lower tubular wall members 15 & 16 can best be understood from FIG. 7 which is an exploded view of the insertion member 28. In this view of insertion tool 28 it has a fishing neck 60, an orientation mule shoe 59 on the up hole end of main tubular body 31 with exterior walls 33 which are sized to slidable fit into the inside diameter 35 of the lower tubular wall member 15. Also passing through the insertion member 28 is a hollow piston cylinder 37 which has a seating surface 56 on its up hole end about a channel 38 which runs the full length of the insertion tool 28. This channel 38 and seating surface 56 located on the up hole end of the hollow piston cylinder 37 are in certain phases of the operation of the insertion tool 28 in the shifting apparatus 10, open to the fluid in the well both above and below the shifting apparatus 10 to allow pressure to equalize in the well. The downhole end of the hollow piston cylinder 37 has a raised portion 39 about it and the raised portion 39 and hollow piston cylinder 37 are seated against a coiled spring 40 which is held in place by a cap 41. The coiled spring 40 is set about a hollow tube 42 which in conjunction with channel 38 provides fluid equalization of the pressure in the well in conjunction with the channel 38. Along the exterior walls 33 are provided uphole retaining box members 43 and down hole retaining box members 44 from which up hole lugs 45 and down hole lugs 46 project.

These up hole lugs 45 are resiliently projected outwardly from the up hole retaining box members 43 by up hole springs 47 which are set against the floor 49 of the up hole retaining box members 43. The up hole lugs 45 are retained in the up hole retaining box members 43 by the retaining tips 51 at the exterior wall 33 which engage with retaining tip 53 on the up hole lugs 45. The up hole lugs 45 have an inclined cam surface 58 on the uphole surface of up hole lugs 45 which when advanced toward the apertures 29 & 30 cause the up hole lugs 45 to be driven back into the up hole retaining box 43 and out of the apertures 29 & 30, which can best be seen in FIG. 9. This removal of the up hole lugs 45 by the up hole motion of the upper tubular wall member 16, thus allows the up hole and down hole tubular wall members 15 & 16 to move freely up and down with in each other for the task of shifting the premilled window section 14.

Figure 8:
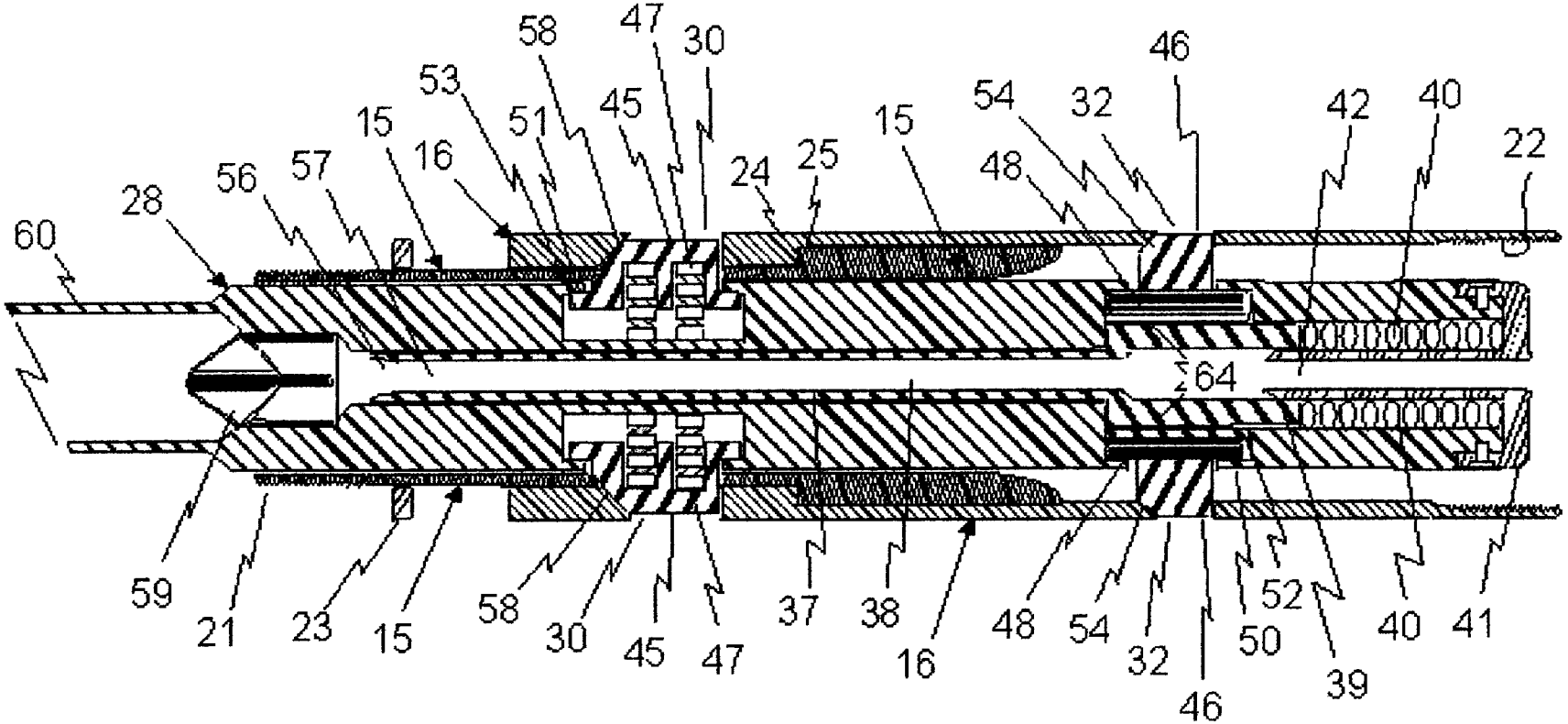
FIG. 8 Is a cross sectional view of the apparatus of this invention fully assembled and in the operational position for being run into the well.
Figure 9:
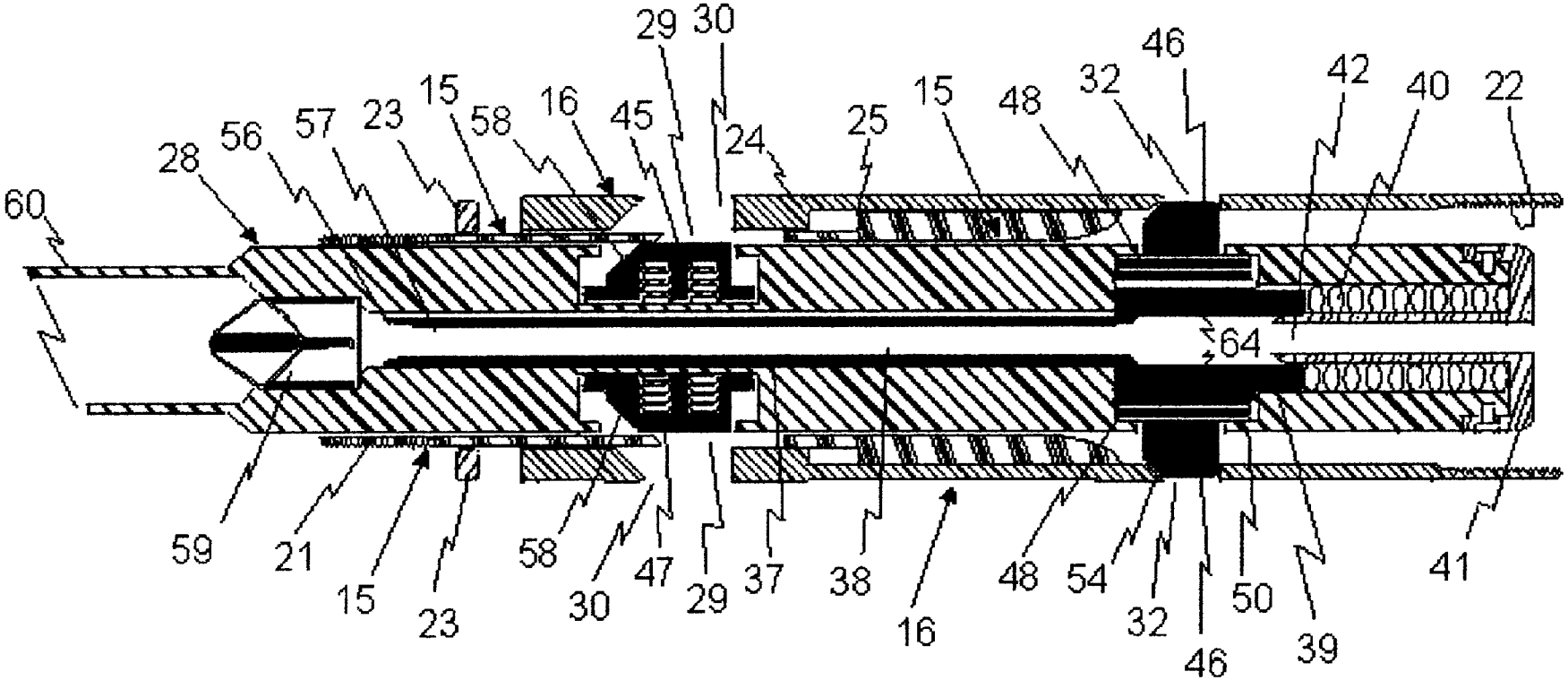
FIG. 9 Is a cross sectional view of the apparatus of this invention fully assembled and in the operational position for orientating or shifting a tool or premilled window section to a desired orientation in the well.
Figure 10:
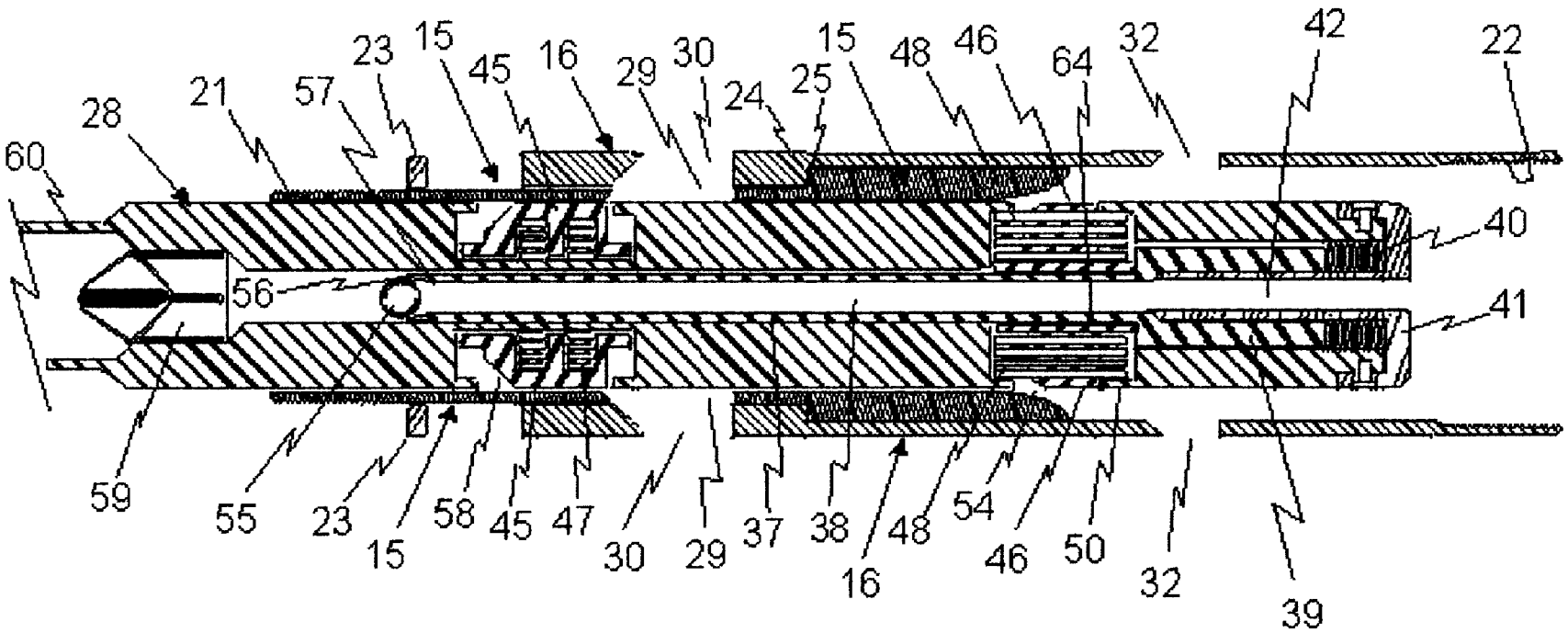
FIG. 10 Is a cross sectional view of the apparatus of this invention fully assembled and in the operational position for the internal tool of this invention to be removed from the upper and lower tubular members and from the well completely.

These down hole lugs 46 are projected outwardly from the down hole retaining box member 44 by the raised portion 39 on hollow piston cylinder 37 which acts as a floor against a bottom portion 64 of these down hole lugs 46. The down hole lugs 46 are retained in the down hole retaining box members 44 by retaining tips 50 at the exterior wall 33 which engage with the down hole springs 48 and the down hole springs 48 which engage with the retaining tips 52 which extend from the bottom portion 64 of the down hole lugs 46 to drive the down hole lugs 46 inward. However in the down hole retaining box member 44 there is no fixed floor, like for the up hole retainer box members 43, and thus in this down hole retaining box member 44, the down hole lugs 46 and their bottom portion 64 are open to mechanical communication with the raised portion 39 about the hollow piston cylinder 37, which provides a floor in one position, as seen in FIGS. 8 & 9, and the hollow piston cylinder 37 provides a floor at a second position, as seen in FIG. 10, when the hollow piston cylinder 37 is moved from the one position to the second position. When the down hole springs 48 are seated against the retaining tips 52 which extend from the bottom portion 64 of the down hole lugs 46 and the bottom portion 64 of the down hole lugs 46 are seated against the raised portion 39 about the hollow piston cylinder 37, the down hole springs 48 are very tightly compressed and the down hole lugs 46 are in a position to be driven inward. Thus once the raised portion 39 is moved by moving the hollow piston cylinder 37 to a second position, the down hole springs 48 drive against the retaining tips 52 on the down hole lugs 46 and the down hole lugs 46 are driven inwardly and back inside the downhole retaining box members 44 to disengage the down hole lugs 46 from the upper tubular wall member 16. Thus once the down hole lugs 46 are driven back into the down hole retaining box member 44, the insertion member 28 is no longer held in the upper and lower tubular wall members 15 & 16, and can be removed from the well.

The operation of the shifting apparatus 10 and the insertion member 28 therein is accomplished, as those skilled in the art will appreciate, by the use of a tubular string, such as a drill string, not shown, being attached to a fishing neck 60 provided on the up hole end 12 of the insertion member 28. Once the drill string is attached to the fishing neck 60, the insertion member 28 may be pulled up hole with the upward movement of the drill string. This upward motion by the drill string activates the release of the up hole lugs 45 and frees the upper tubular wall member 16 for movement. It will be remembered that the upper tubular wall member 16 is also connected to the premilled window section 14, so that once the upper tubular wall member 16 is free for rotation with the drill string to a desired position, so is the premilled window section 14 or any other tubular strings below the shifting apparatus 10. Once the desired position for the premilled window section 14 is achieved, then the drill string is moved back down hole to engage either the lips 24 and 25 or their respective engaging teeth 26 & 27 against further motion between the upper and lower tubular wall members 15 & 16. Once the desired position is achieved for the premilled window section 14, then a seal ball 55 would be dropped into the drill string which would allow it to come to rest on the seating surface 56 located on the up hole end of the hollow piston cylinder 37. When this seal ball 55 seats on the seating surface 56 pressure can then be added to the well fluid above the seal formed between the seal ball 55 and the seating surface 56 until a pressure sufficient to move the hollow piston cylinder 37 in a down hole direction is achieved. Once the hollow piston cylinder 37 is moved down hole, the raised portion 39 about the hollow piston cylinder 37 would be moved from one position to another and the bottom portion 64 of the down hole lugs 46 would be driven inward to the hollow piston cylinder 37 by the compressed down hole springs 48, and out of engagement with the apertures 32 in the upper tubular wall member 16. In this position the drill string can pull up and remove the insertion member 28 from the upper and lower tubular wall members 15 & 16 and completely out of the well. The removal of the insertion member 28 in this manner from the upper and lower tubular wall members 15 & 16 provides a well with a casing bore which is full open for further well operations, which in the case of this embodiment would be the drilling of a multilateral well.

It will be appreciated by those skilled in the art that on some occasions the premilled window section 14 will either be in the proper orientation or that the casing string 11 can be oriented by rotation of the casing sting 11 from the surface of a well which would thereby eliminated the need to use the shifting apparatus 11 of this invention. In any of those cases with the shifting apparatus 10 of this invention, the removal of the insertion member 28 can be accomplished with a Fishing Tool on a wire line or drill string, not shown, which can be mated to the fishing neck 60 located on the up hole end of the insertion member 28 for the removal of the insertion member 28 from the well bore. This removal of the insertion member 28 with a fishing tool saves the cost of running a drill string back into the well to remove this insertion member 28.

In any manner that the insertion member 28 is removed from the upper and lower tubular members 15 & 16, it will be appreciated that the down hole lugs 46 should not hang up in the removal of the insertion member 28. Therefore in addition to the down hole springs 48 driving the retaining tips 52 on the down hole lugs 46 inward toward the hollow piston cylinder 37 so as not to hang in the removal process, the down hole lugs 46 also have a small inclined surface 54 on their up hole end to allow them to easily pass through the down hole tubular wall member 15 and to facilitate the removal of the insertion member 28 from the well.

The practice of the method of this invention with this shifting apparatus 10 can best be described by referring to FIG. 8, which shows the shifting apparatus fully assembled and ready to be run with a casing string 11 into a well bore. It should be noted that the upper and lower tubular wall members 15 & 16 are locked into place by the up hole lugs 45 passing into the apertures 29 & 30, and the down hole lugs 46 being inserted into the apertures 32 by the raised portion 39 of the hollow tubular cylinder 37. In this configuration the shifting apparatus 10 of this invention would be run into the well and then a check of it's orientation would be made. A line would be lowered with a surveying devise, not shown, attached to it and the surveying devise would mate with the orientation mule shoe 59 on the up hole end of the main tubular body 31. As the orientation mule shoe 59 is mounted in a known orientation to the premilled window section 14, the surveying devise would advise the well operator on the surface how the premilled window section 14 was orientated and whether re-orientation was necessary.

If it was deemed necessary to re-orient the premilled window section 14, then as shown in FIG. 9 the method of this invention would continued by pulling up hole on the insertion member 28, by way of the fishing neck 60, for the selective release of the up hole lugs 45. These up hole lugs 45 are driven completely into the uphole retaining box member 43 and out of apertures 29 & 30, by the inclined cam surfaces 54 being driven against aperture 30. At this stage of the method of the use of this shifting apparatus 10 the up hole and down hole tubular wall member 15 & 16 would be free of each other for both up and down hole movement and also rotational movement to orient the premilled window section 14 to the desired location in the well bore. As the down hole lugs 46, at this stage of the method of this invention, are still engaged, thus when the up hole pull occurs it raises the up hole tubular wall member 16 from down hole tubular wall member 15 to separate the engaged teeth 26 and 27 for allowing the free rotation of the upper tubular wall 16 and the premilled window section 14. As the the down hole tubular wall member 15, which is connected to the casing string 11 up hole of the shifting tool 10 is unengaged from the upper tubular wall member 16 it is substantially unchanged in orientation whether by choice or because it is binding in the well bore. Once oriented the upper tubular wall member 16 is lowered to reengage the engaging teeth 26, & 27 against any movement while other operations are performed in the well.

As seen in FIG. 10 the premilled window section 14 has been oriented and the insertion member 28 has been prepared for removal from the well. This preparation for removal from the well is achieved by the method of dropping a seal ball 55 down the well and allowing the seal ball 55 to seat on the seating surface 56, which is on the up hole end 57 of the hollow tubular cylinder 37. The method of this invention is then further carried on by pumping fluid against the seal formed by the seal ball 55 and seating surface 56, and the hollow piston cylinder 37 until the hollow piston cylinder 37 is driven down hole and moves the expanded portion 39 about the hollow piston cylinder 37 downward. Once this expanded portion 39 is moved from it's one position to another position it allows the down hole lugs 46 and down hole springs 48 to be moved inward thus pushing the expanded surface 62 and down hole lugs 46 into the down hole retaining box member 44. Once the down hole lugs 46 are in the down hole retaining box member 44 then a drill string or even a wire line or any other retrieval device may be used to remove the insertion member 28 from the well. The results of the method and use of the apparatus of this inventions is to provide a clear casing string for further work therein and the premilled window section 14 located in its desired orientation.

While the preferred embodiments of the invention and the methods of their use have been described for the assembly for providing a means of support and positioning for drilling at least one multi-lateral well from a well bore in a well having tubular walls and for providing a means for entry and reentry into and through the longitudinally premilled window and their use, it will be appreciated that other embodiments and methods may be used without departing from the spirit of the invention.

We claim:

1. A shifting apparatus for use with a tubular string set in a well for selective unlocking and orientation of sections of said tubular string below said shifting apparatus while said sections above said shifting apparatus remain substantially unchanged in orientation in said well comprising, a lower tubular wall means connected to said tubular string above said shifting apparatus, an upper tubular wall means selectively connected to said lower tubular wall means for controlled movement between said lower tubular wall means and said upper tubular wall means, and connected to said tubular string below said shifting apparatus, and an internal tool means located inside said upper and lower tubular wall means for releasablely and selectively locking into said upper and lower tubular wall means for holding said upper and lower tubular wall means engaged until orientation of said tubular string below said shifting apparatus is desired and for releasablely and selectively unlocking said upper tubular wall means from said lower tubular walls means for allowing said upper tubular wall means and said tubular string below said shifting apparatus to be rotationally oriented by said internal tool means with said lower tubular wall means and said tubular string above said shifting apparatus remaining substantially unchanged in orientation in said well.

2. The shifting apparatus for use with a tubular string set in a well for selective unlocking and orientation of sections of said tubular string below said shifting apparatus and with said sections above said shifting apparatus remaining substantially unchanged in orientation in said well as in claim 1 wherein said upper tubular wall means further comprises, a receiving means formed inside said upper tubular wall means for receiving said lower tubular wall means.

3. The shifting apparatus for use with a tubular string set in a well for selective unlocking and orientation of sections of said tubular string below said shifting apparatus and with said sections above said shifting apparatus remaining substantially unchanged in orientation in said well as in claim 2 wherein said receiving means formed inside said upper tubular wall means further comprises having an increased inside diameter from said tubular wall means.

4. The shifting apparatus for use with a tubular string set in a well for selective unlocking and orientation and locking of sections of said tubular string below said shifting apparatus and with said sections above said shifting apparatus remaining substantially unchanged in orientation in said well as in claim 3 wherein said lower tubular means further comprises, a tubular means having an outside diameter for being received in said receiving means formed inside said upper tubular wall means, and an insertion means formed by said outside diameter of said lower tubular wall means having an outside diameter for being slidablely passed through said upper tubular wall means and for attachment to said tubular string above said shifting apparatus.

5. The shifting apparatus for use with a tubular string set in a well for selective unlocking and orientation of sections of said tubular string below said shifting apparatus and with said sections above said shifting apparatus remaining substantially unchanged in orientation in said well as in claim 4 further comprising, an orientation means located on said shifting apparatus in know alignment with said tubular string below said shifting apparatus for indication of the orientation of said lower tubular string.

6. The shifting apparatus for use with a tubular string set in a well for selective unlocking and orientation of sections of said tubular string below said shifting apparatus and with said sections above said shifting apparatus remaining substantially unchanged in orientation in said well as in claim 5 further comprising, a means located on said internal tool means for allowing retrieval of said internal tool means from said upper and lower tubular wall means.

7. The shifting apparatus for use with a tubular string set in a well for selective unlocking and orientation of sections of said tubular string below said shifting apparatus and with said sections above said shifting apparatus remaining substantially unchanged in orientation in said well as in claim 6 wherein said internal tool means located inside said upper and lower tubular wall means further comprises, movable means located up hole in said internal tool means for selective engagement with said upper and lower tubular wall means, and movable means located down hole in said internal tool means for selective engagement with said upper tubular wall means.

8. The shifting apparatus for use with a tubular string set in a well for selective unlocking and orientation of sections of said tubular string below said shifting apparatus and with said sections above said shifting apparatus remaining substantially unchanged in orientation in said well as in claim 7 wherein said upper and lower tubular wall means further comprise, at least one aperture means formed in said upper tubular wall means and at least one aperture means formed in said lower tubular wall means for allowing alignment with said at least one aperture means of said upper tubular wall means and for allowing receipt of said movable means located in said internal tool means for selectively locking and unlocking of said upper tubular wall means with said lower tubular wall means.

9. The shifting apparatus for use with a tubular string set in a well for selective unlocking and orientation of sections of said tubular string below said shifting apparatus and with said sections above said shifting apparatus remaining substantially unchanged in orientation in said well as in claim 8 wherein said upper tubular wall means further comprises, at least one aperture means formed in said upper tubular wall means for receipt of said movable means located down hole on said internal tool means which when aligned with said movable means down hole in said internal tool allows for selectively locking and unlocking of said upper tubular wall means with said internal tool means.

10. The shifting apparatus for use with a tubular string set in a well for selective unlocking and orientation of sections of said tubular string below said shifting apparatus and with said sections above said shifting apparatus remaining substantially unchanged in orientation in said well as in claim 9 wherein movable means located in said internal tool means for selective engagement with said upper and lower tubular wall means further comprises, at least one spring means, at least one retaining box means located on said internal tool means for receiving said at least one spring means, and at least one lug means having an up hole and down hole surface for being retained in said at least one retaining box means against said at least one spring means and for being driven outward of said at least one retaining box means by said at least one spring means into engagement with said at least one aperture on said upper and lower tubular wall means.

11. The shifting apparatus for use with a tubular string set in a well for selective unlocking and orientation of sections of said tubular string below said shifting apparatus and with said sections above said shifting apparatus remaining substantially unchanged in orientation in said well as in claim 10 wherein said at least one lug means further comprises, an inclined camed surface on said up hole surface of said at least one lug means for driving said at least one lug means into said at one retaining box means and for releasing said one lug means from engagement with said upper and lower tubular wall means.

12. The shifting apparatus for use with a tubular string set in a well for selective unlocking and orientation of sections of said tubular string below said shifting apparatus and with said sections above said shifting apparatus remaining substantially unchanged in orientation in said well as in claim 11 wherein movable means located down hole on said internal tool means for selective engagement with said upper tubular wall means further comprises, at least one hollow movable cylinder piston means for movement from one position to another position passing through said internal tool means having an up hole end, a down hole end, and a channel therethrough, a spring means biased against said down hole end of said at least one hollow movable cylinder piston means for resiliently holding said at least one hollow movable cylinder piston means against inadvertent movement in one position and for being compressed by said at least one hollow movable cylinder piston means in another, and a raised stopping surface means about said at least one hollow movable piston means proximate said down hole end of said at least one hollow movable piston means for providing a floor for said at least one spring means in said at least one retaining box means in one position and for locking said lug means in said at least one retaining box means in another position in conjunction with said spring means biased against said down hole end.

13. The shifting apparatus for use with a tubular string set in a well for selective unlocking and orientation of sections of said tubular string below said shifting apparatus and with said sections above said shifting apparatus remaining substantially unchanged in orientation in said well as in claim 12 wherein said internal tool means for selective engagement with said upper tubular wall means further comprises, a valve means on said up hole end of said at least one hollow movable cylinder piston means for closing said channel through said at least one hollow movable cylinder piston means to fluid flow and for driving said at least one hollow movable cylinder piston means from one position against said spring means biased against said down hole end of said internal tool means to another position in response to hydraulic pressure created by fluid being pumped down hole.

14. The shifting apparatus for use with a tubular string set in a well for selective unlocking and orientation of sections of said tubular string below said shifting apparatus and with said sections above said shifting apparatus remaining substantially unchanged in orientation in said well as in claim 13 wherein said movable means located down hole in said internal tool means for selective engagement with said upper tubular wall means further comprises, at least one spring means, at least one retaining box means open for mechanical communication on at least one side located on said internal tool means for receiving said at least one spring means, at least one lug means having having an expanded portion for being retained in said at least one retaining box means against said at least one spring means and for being driven downward into said at least one retaining box means by said at least one spring means out of engagement with said at least one aperture on said upper tubular wall means.

15. The shifting apparatus for use with a tubular string set in a well for selective unlocking and orientation of sections of said tubular string below said shifting apparatus and with said sections above said shifting apparatus remaining substantially unchanged in orientation in said well as in claim 14 wherein said valuing means further comprises, a seating surface on said up hole end of said at least one hollow movable cylinder piston means having a channel therethrough and a seat ball means for being dropped into place over said seating surface on said up hole end of said at least one hollow movable cylinder piston means to form a seat against which fluid may be pumped to drive said at least one hollow movable cylinder piston means from one position to another position down hole.

16. The shifting apparatus for use with a tubular string set in a well for selective unlocking and orientation of sections of said tubular string below said shifting apparatus and with said sections above said shifting apparatus remaining substantially unchanged in orientation in said well as in claim 15 wherein said upper and lower tubular wall means further comprise, engaging teeth means located on said upper and lower tubular wall means for selective engagement with each other for releasable holding of said upper and lower tubular wall means from rotational, orientational motion while engaged.

17. The shifting apparatus for use with a tubular string set in a well for selective unlocking and orientation of sections of said tubular string below said shifting apparatus and with said sections above said shifting apparatus remaining substantially unchanged in orientation in said well as in claim 16 wherein said engaging teeth means further comprise, teeth means formed in said lower tubular wall means from said outside diameter of said lower tubular wall means and by said reduced outside diameter of said lower tubular wall sufficient to be slidablely passed through said inside diameter of said upper tubular wall means.

18. The shifting apparatus for use with a tubular string set in a well for selective unlocking and orientation of sections of said tubular string below said shifting apparatus and with said sections above said shifting apparatus remaining substantially unchanged in orientation in said well as in claim 17 wherein said engaging teeth means further comprise, teeth means formed in said upper tubular wall means from said inside diameter of said upper tubular wall means by said increased inside diameter of said upper tubular wall sufficient to slidablely receive said insertion means formed by said outside diameter of said lower tubular walls means.

19. The shifting apparatus for use with a tubular string set in a well for selective unlocking and orientation of sections of said tubular string below said shifting apparatus and with said sections above said shifting apparatus remaining substantially unchanged in orientation in said well as in claim 18 wherein said engaging teeth means formed on said upper and lower tubular wall means comprise, sufficient number of engaging teeth means formed to give accurate degrees of rotation and not so many engaging teeth means formed as for them to be too small to hold the forces which would attempt to inadvertently rotate said upper and lower tubular wall means before desired.

20. The shifting apparatus for use with a tubular string set in a well for selective unlocking and orientation of sections of said tubular string below said shifting apparatus and with said sections above said shifting apparatus remaining substantially unchanged in orientation in said well as in claim 19 wherein said sufficient number of engaging teeth means formed on said upper and lower tubular wall means comprise, more than 4 and less than 120.

21. A method of using a shifting apparatus having an upper tubular wall member connected to the section to be oriented and having a lower tubular wall member and an internal tool located therein with a tubular string set in a well for selective unlocking and orientation of sections of said tubular string below said shifting apparatus and with said sections above said shifting apparatus remaining substantially unchanged in orientation comprising, connecting said shifting apparatus in said tubular string to be set in said well above said sections of said tubular string to be shifted, running said tubular string into said well, checking said orientation of section to be orientated, pulling up hole on said internal tool for selectively releasing said lower tubular wall member from said upper tubular wall member, rotating said internal tool for rotating said upper tubular wall member and said sections of said tubular string below said shifting apparatus to said desired orientation, letting down on said internal tool for relocking said upper and lower tubular wall members, releasing said internal tool from said upper and lower tubular wall members, and removing said internal tool from said upper and lower tubular wall members and out of the well bore for leaving a fully clear well bore and properly oriented tubular string below said upper and lower tubular wall members of the remaining shifting apparatus.

22. The method of using a shifting apparatus having an upper tubular wall member connected to the section to be oriented and having a lower tubular wall member and an internal tool located therein with a tubular string set in a well for selective unlocking and orientation of sections of said tubular string below said shifting apparatus and with said sections above said shifting apparatus remaining substantially unchanged in orientation as in claim 21 wherein said step of releasing said internal tool from said upper tubular wall means further comprise, dropping a sealing ball means into said well to form a seal in said insertion means, and pumping fluid against said seal formed in said insertion means for releasing said at least one lug means having an expanded portion for being retained in said at least one retaining box means against said at least one spring means and for being driven downward into said at least one retaining box means by said at least one spring means out of engagement with said at least one aperture on said upper tubular wall means.

* * * * *